United States Patent [19]

Miller

[11] Patent Number: 4,577,994

[45] Date of Patent: Mar. 25, 1986

[54] VIBRATORY CONCRETE SCREED

[75] Inventor: Thomas E. Miller, Mequon, Wis.

[73] Assignee: Metal Forms Corporation, Milwaukee, Wis.

[21] Appl. No.: 615,696

[22] Filed: May 29, 1984

Related U.S. Application Data

[63] Continuation of Ser. No. 336,307, Dec. 31, 1981, abandoned.

[51] Int. Cl.[4] ..... E01C 19/40

[52] U.S. Cl. ..... 404/114; 404/119; 425/456

[58] Field of Search ..... 404/96, 97, 106, 114, 404/118-120; 425/456

[56] References Cited

U.S. PATENT DOCUMENTS

| | | | |
|---|---|---|---|
| 2,094,910 | 10/1937 | Baily | 404/96 |
| 2,542,979 | 2/1951 | Barnes | 404/114 |
| 2,586,472 | 2/1952 | McKown | 404/97 X |
| 2,813,466 | 11/1957 | Torgerson | 404/97 X |
| 3,113,494 | 12/1963 | Barnes | 404/114 |
| 3,220,322 | 11/1965 | Lewis | 404/114 |
| 3,256,788 | 6/1966 | Schweihofer et al. | 404/120 |
| 3,435,740 | 4/1969 | McGall . | |
| 4,030,873 | 6/1977 | Morrison . | |
| 4,132,492 | 1/1979 | Jenkins | 404/119 |
| 4,229,118 | 10/1980 | Kisling | 404/118 X |
| 4,249,327 | 2/1981 | Allen . | |
| 4,256,416 | 3/1981 | Bishop | 404/119 |

OTHER PUBLICATIONS

AWS Manufacturing, Inc., "The AWS Concrete Screed", copyright 1982, all pages.

H. Compton Co., "Texas Vibratory Straight Edge", copyright 1982, one page.

Allen Engineering Corp., "Allen Razorback Vibratory Air Screed", copyright 1979, all pages.

Allen Engineering Corp., "Allen Engine Driven Screed", copyright 1979, all pages.

Morrison's Concrete & Equipment, Inc., "Morrison's Proudly Presents Superscreed", copyright 1977 and 1978, all pages.

*Primary Examiner*—Stephen J. Novosad

*Assistant Examiner*—John F. Letchford

*Attorney, Agent, or Firm*—Hill, Van Santen, Steadman & Simpson

[57] ABSTRACT

A device for screeding and finishing concrete pavements having an elongate sectional framework, turnbuckles between framework sections to provide a crown or sag, a rotating shaft with eccentric weights driven by an internal combustion engine to impart vibration, hydraulic pumps and motors driving winches for self-propulsion of the device across the concrete. The screed bars are hollow rectangular members having two useable wearing surfaces. The screed bars may be rotated to bring their second wearing surfaces into contact with the concrete.

2 Claims, 6 Drawing Figures

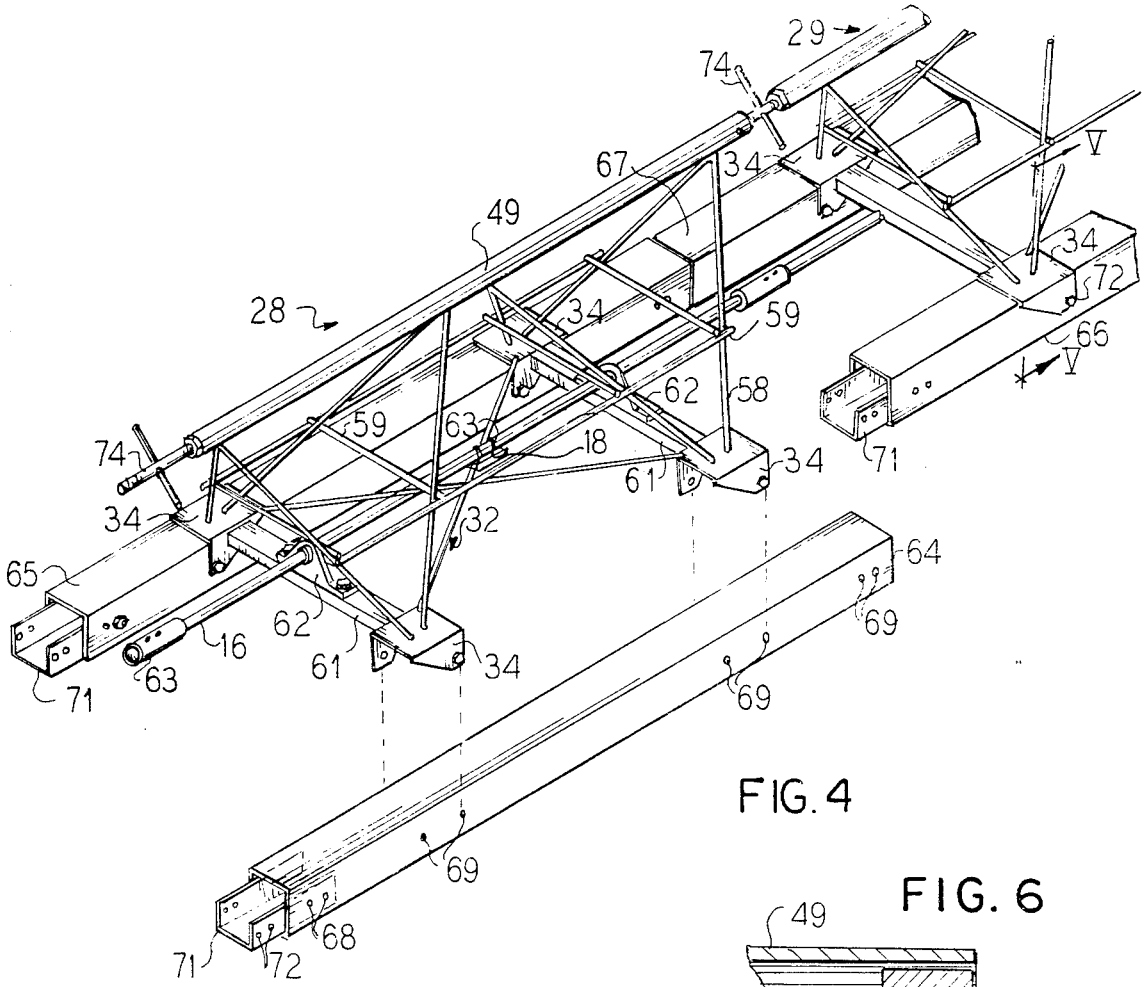
FIG. 4
FIG. 6
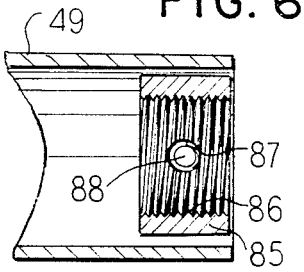
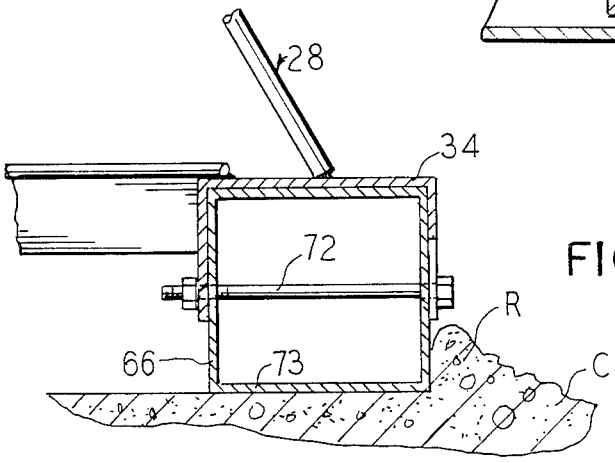
FIG. 5

VIBRATORY CONCRETE SCREED

This application is a continuation of application Ser. No. 336,307, filed Dec. 31, 1981, now abandoned.

BACKGROUND OF THE INVENTION

1. Field of the Invention

This invention relates to a vibratory screed for use in finishing freshly placed concrete pavements.

2. The Prior Art

A variety of screeding devices is disclosed in the prior art. U.S. Pat. No. 4,030,873 (Morrison) discloses a screed device having multiple elongated frame sections with vibratory action imparted by a motor-driven rotating shaft. The screed bars are L-shaped metallic members.

U.S. Pat. No. 3,435,740 (McGall) discloses a screed device having multiple elongated frame sections from which depend rectangular, reciprocating, metallic screed bars, and further having hand winch advancing means.

U.S. Pat. No. 4,249,327 (Allen) discloses a screed device with multiple elongated frame sections, hand winch advancing means and pneumatic vibrators. The front screed bar is an inverted T-shaped metallic member and the rear screed bar is an L-shaped metallic member.

Other screed devices known to those skilled in this art include features such as self-propelled hydraulic winches, adjustable crown or sag means, eccentric weights spaced along a rotating vibrator shaft, and fine grader attachment devices.

Heretofore, screed devices of the type to which the present invention relates have had screed bars with but one useable wearing surface for downwardly engaging the fresh concrete. When that surface is no longer useable due to the abrasive effects of the concrete, the worn screed bar must be removed, discarded and replaced with a new one at significant expense.

The present invention solves this problem by providing a screed device with detachable screed bars which are invertible about their longitudinal axes to provide two useable wearing surfaces. Furthermore, the screed device of the invention combines other advantageous features in a unique manner to provide a highly effective device.

SUMMARY OF THE INVENTION

According to the invention, a vibratory concrete screed device is provided with forward and rear elongated screed bars depending from a plurality of inverted U-shaped brackets secured to an elongated space truss. The screed bars are rectangular and hollow in cross-section. Bores are provided through the vertical surfaces of the brackets and through the screed bars midway between the upper and lower surfaces thereof so that the screed bars are secured within and below the brackets by the insertion of bolts through the aligned holes.

When the lower surface of the screed bar has worn to the extent that it no longer produces an acceptable concrete finish, the bolts are removed, the screed bar is inverted, and the bolts are reinserted to furnish a new screed bar wearing surface.

The screed device of the invention is provided in multiple sections of various lengths so that pavements of various widths may be finished and portability is enhanced. Turnbuckle means are placed between sections so that the screed device may be adjusted to produce a crown or sag.

An internal combustion engine mounted on the screed device drives a longitudinal rotating shaft with counterweights spaced therealong to impart vibratory action. The engine also drives a hydraulic system which in turn drives winches for self-propelling the screed device along the line of work.

BRIEF DESCRIPTION OF THE DRAWINGS

FIG. 4 is a perspective view of one section and a fragment of an adjacent section of the screed device of FIG. 1 with one screed bar disassembled;

FIG. 5 is a sectional view taken substantially along the line V—V of FIG. 4; and FIG. 6 is a fragmentary sectional view taken of one end of the upper chord member showing the floating nut of the turnbuckle means.

DESCRIPTION OF A PREFERRED EMBODIMENT

Figure 1:
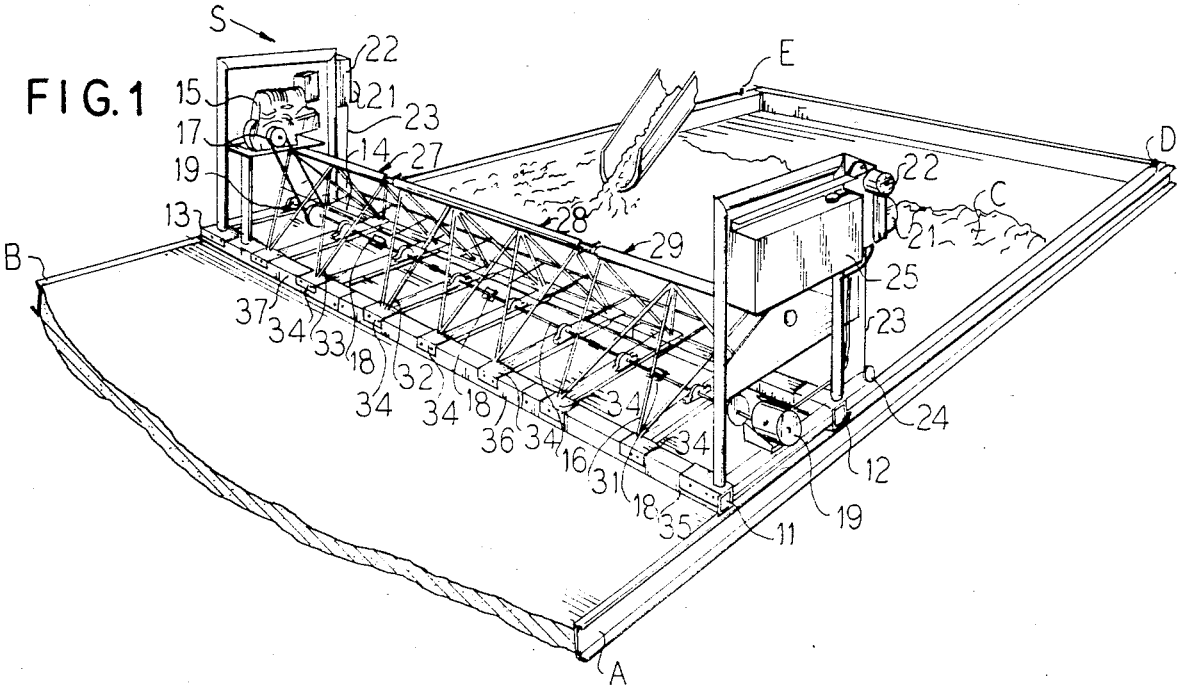
FIG. 1 is a perspective view showing a screed device embodying the principles of the invention as used in screeding and finishing a freshly poured concrete pavement.

As shown in FIG. 1, the screed device S of this invention may be oriented transversely atop a concrete pavement to be screeded and finished, the ends of the screed bars 11, 12, 13 and 14 resting upon the side forms A and B. The screed device is suitable for use with a variety of concrete pavements including floors, slabs, bridge decks, streets, sidewalks, and approaches.

A source of power such as an internal combustion engine 15 is mounted at one end of the screed device S and drives a rotating shaft 16 which extends for the length of the screed device S by means of a pulley and belt arrangement 17. Eccentric weights 18 spaced along the rotating shaft 16 impart vibratory action to the screed device thus aiding in consolidation of the fresh concrete.

At each end of the screed device S there is mounted a hydraulic pump 19 coupled to the end of the rotating shaft 16. Also mounted at each end there is a winch 21 and a hydraulic motor 22. The winch cables 23 descend from the winches 21, pass through pulleys 24 and extend longitudinally generally parallel to the line of work to remote points D and E where they are anchored.

In operation, the internal combustion engine 15 and pulley arrangement 17 cause the shaft 16 to drive the hydraulic pumps 19, which in turn drive the hydraulic motors 22, causing the winches 21 to take up the cables 23. In this manner, the screed device S is self-propelled forward across the fresh concrete C.

Hydraulic fluid is stored in tanks 25. Valving means may be provided at each hydraulic motor 22 so that the forward travel speed may be adjusted independently of the engine speed and vibrational frequency.

The screed device S is formed of interconnected longitudinal sections 27, 28 and 29. It is convenient to provide the sections in various lengths to accommodate pavements of differing widths. Each section comprises a space truss 31, 32 and 33, brackets 34, and hollow rectangular screed bars 35, 36 and 37 depending from the brackets 34. The screed bars 35, 36 and 37 may be detached from the brackets 34, inverted, and reattached to the brackets 34 to provide a new wearing surface as will be discussed more fully below.

Figure 2:
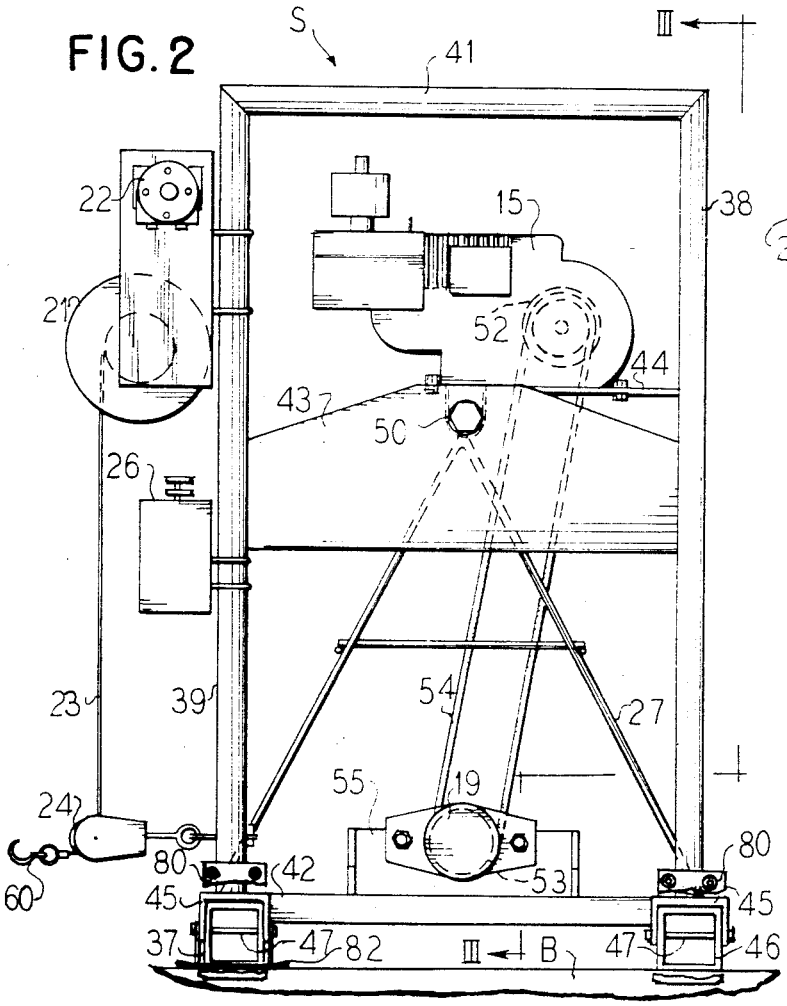
FIG. 2 is an end view looking inwardly at the left hand end of the screed device shown in FIG. 1.
Figure 3:
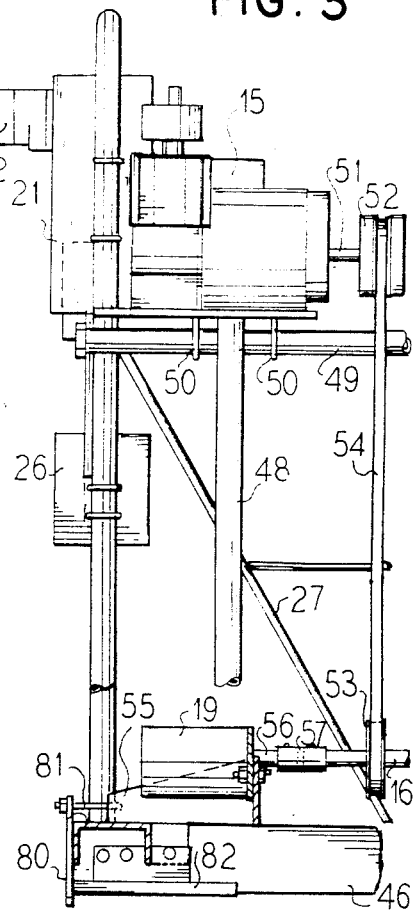
FIG. 3 is a fragmentary sectional view taken substantially along the line III—III of FIG. 2.

Referring now to FIG. 2 and FIG. 3, the arrangement of the self-propelling features of the screed device S of the invention may be seen in more detail. As shown on FIG. 2, at the end of the screed device there is attached an end frame comprising two vertical members 38 and 39, two horizontal members 41 and 42, a web plate 43, and two brackets 45 at the lower corners. The brackets 45 straddle the forward and rear screed bars 37 and 46 and are attached thereto by bolts 47 inserted through co-aligned holes formed through the brackets 45 and screed bars 37 and 46.

As best seen in FIG. 3, an internal combustion engine 15 is mounted atop a platform 44 near the end of the screed section 27. One end of the platform is supported by a post 48 which has a bracket at its lower end for bolting to the forward screed bar 46. The other end of the platform 44 is secured to the upper cord of the screed section 27 by U-bolts 50.

At the end of the output shaft 51 of the internal combustion engine 15, there is a centrifugal clutch 52. Below the centrifugal clutch 52 there is affixed to the rotating shaft 16 a pulley 53. A belt 54 drivingly connects the centrifugal clutch 52 and the pulley 53.

Attached to the end frame lower member 42 by means of a bracket 55, there is a hydraulic pump 19. The input shaft 56 of the pump is drivingly connected to the rotating shaft 16 by connector means such as a universal joint or a coupling 57.

As best seen on FIG. 2, there is attached to the upper end of the vertical end frame member 39 a hydraulic motor 22 and a winch 21. Hydraulic fluid stored in the tank 26 and carried to the motor 22 from the pump 19 by means of a hydraulic hose causes the motor 22 to drive the winch 19 which takes up cable 23 through the pulley 24. If the hook 60 is attached to a remote fixed point, it can be seen that the screed device will be propelled forward across the fresh concrete.

At the other end of the screed device S there is a similar arrangement of an end frame with a pump 19, motor 22, winch 21, and tank 25. The other end of the rotating shaft 16 is coupled to the pump 19, thus similarly driving the motor 22, winch 21 and propelling the screed device S. Valving means such as a flow regulator may be provided at each end of the screed device S so that the travel speed may be adjusted or arrested independently of the engine speed. The centrifugal clutch 52 allows the travel and vibration to be stopped without shutting off the engine 15. Furthermore, the vibrational frequency may be adjusted within limits without affecting travel speed.

Edge guides 80 may be attached at each end of the screed bars 37 and 46. The edge guides 80 are substantially rectangular plates having their upper ends attached to the vertical members 38 and 39 by U-bolts 81. The lower ends of the edge guides 80 extend below the bottom surfaces of the screed bars 37 and 46 thereby limiting lateral movement of the screed device. The edge guides are of particular effectiveness in preventing downward sliding of the screed device when in use on superelevated pavements.

Ski attachments 82 may be provided near the ends of the forward screed bar 37. Each ski attachment 82 is a plate having its forward and rearward edges bent upward. When secured under the forward screed bars 37, the ski attachment 82 rides atop the side form B, thus slightly elevating the front screed bar above the final grade level and allowing the rear screed bar to carry a roll of concrete. In this manner, an improved finish may be achieved with greater compaction.

As shown in FIG. 4, the structural details of the screed sections may be seen. A screed section 28 comprises an elongated space truss 32 generally triangular in cross-section having web members 58, cross-bracing members 59, lower transverse members 61 and an upper chord member 49.

The rotating shaft 16 passes longitudinally through the space truss 32 supported above the transverse members 59 by bearings such as pillow blocks 62. At each end of the rotating shaft, there is a coupling for connection to the rotating shaft of an adjacent screed section or to the input shaft 56 of the pump 19 as better shown in FIG. 3.

At least one eccentric weight 18 is secured along the rotating shaft 16 by U-bolts 63. The weight imparts vibratory action to the screed section with the vibrational frequency controllable by adjusting the engine speed. The number and spacing of the weights 18 along the rotating shaft 16 may be determined by the operator in the field according to the concrete workability.

At the ends of the lower transverse member 61 and the lower ends of the web members 58, there are attached screed bar brackets 34. These brackets 34 are inverted U-shaped with two diagonally opposite corners being clipped at an angle. A hole is formed in each vertical face of the brackets 34.

The screed bars 64, 65, 66 and 67 are hollow, rectangular metallic members, preferably of aluminum for light weight and durability. Opposing pairs of holes are formed at intervals along the vertical faces of the screed bar as at 68 and 69. The holes are midway between the upper and lower surfaces of the screed bar. A channel member 71 is inserted in the ends of the screed bars 64, 65, 66 and 67. Holes 72 are formed in the sides of the channel members 71 so that when the holes 72 are brought into alignment with the holes 68 of adjacent screed bars and bolts are inserted therethrough, the ends of the bars will be held in abutting relation.

FIG. 5 shows the cooperation of the screed bars and screed bar brackets of the invention. The screed bar 66 is nested securely within the screed bar bracket 34. The bolt 72 inserted through the co-aligned holes of the screed bar 66 and screed bar bracket 34 secure the screed bar 66 to the screed section 28.

In operation, the lower surface of the screed bar slides over the surface of the fresh concrete C preferably pushing a small roll R of concrete in front of the leading surface of the screed bar. Eventually, the lower surface of the screed bar will wear out due to the abrasion of the concrete and will no longer produce an acceptable finish. Rather than discard the screed bar, the present invention doubles screed bar life by providing two useable finishing surfaces. The bolts 72 are removed from the screed bars 64, 65, 66 and 67, the screed bars are inverted, replaced in the brackets 34, and the bolts 72 are reinserted and tightened.

Furthermore, the rectangular screed bars possess greater stiffness than L-shaped or T-shaped bars, and therefore produce a more level concrete surface. Also, there is no tendency for the leading edge of the screed bar to pick up and accumulate concrete as with T or L-shaped bars.

The ends of the upper cord members 49 are fitted with turnbuckle means 74. Rotating the turnbuckles 74 causes the adjacent upper cord member ends to be either pulled together or pushed apart, thus creating a sag or crown concrete surface respectively.

To accommodate the angle produced between screed sections 28 and 29 by rotating the turnbuckles 74, a floating nut arrangement is provided at the ends of the upper chord members 49. As shown in FIG. 6., the nut 85 having internal threads 86 has an outer diameter somewhat smaller than the inside diameter of the upper chord member 49. Horizontal dowels 88 protruding within the upper chord member 49 enter holes 87 provided in the nut 85. The holes 87 are of a diameter large enough to allow the nut 85 to rotate about a horizontal axis defined by the dowels 88. In this manner, binding of the turnbuckle 74 is prevented when the screed device is used on pavements having a crown or sag.

The winches 21 may be provided with clutch means so as to allow the cables 23 to be played out rapidly. Furthermore, with valving means at the hydraulic motors 22, the flow of hydraulic fluid may be regulated so that the vibrational frequency of the screed device is not affected.

As is now apparent, a new and useful vibratory concrete screed is provided having invertible screed bars with two wearing surfaces. Although modifications might be suggested by those skilled in the art, it will be understood that I wish to embody within the scope of the patent described herein all such modifications as reasonably and properly come within the scope of my contribution to the art.

I claim:

1. Screed apparatus comprising:

an elongate frame adapted for movement along a pair of spaced side forms;

a pair of screed bars mounted on said frame spaced apart in the direction of movement and extending transversely to the direction of movement, each of said screed bars comprising first and second opposed sides; and mounting means for releasably mounted said screed bars at points of attachment to said frame such that either of said first and second opposed sides may be oriented for contact with the concrete.

2. In a screed apparatus of the type in which a frame is mounted for movement along a pair of spaced side forms, in which the frame mounts at least one elongate screed bar extending between the side forms for engaging and finishing concrete between the side forms, and in which a vibratory drive is mounted on the frame and imparts vibrations to the screed bar to aid in the finishing of the concrete, the improvement in combination therewith comprising:

first and second opposed sides on the screed bar and third and fourth sides connecting said first and second sides and therewith defining a hollow, rectangular cross-section screed bar;

a plurality of first holes spaced apart along and through said third side of the screed bar half-way between said first and second side;

a plurality of second holes spaced apart along and through said fourth side of the screed bar and aligned with said first holes half-way between said first and second sides; and attachment means for releasably securing the screed bar to the frame to selectively place said first or second side down for engagement with the concrete, said attachement means comprising mounting plates carried spaced apart on the frame, a plurality of third holes through said mounting plates for alignment with respective first and second holes, and fastening means, including a plurality of bolts to be received in the aligned holes, to secure the screed bar to the frame.

* * * * *